United States Patent [19]

Pettersson et al.

[11] Patent Number: 4,624,634

[45] Date of Patent: Nov. 25, 1986

[54] METHOD AND ARRANGEMENT FOR IMPROVING THE HEAT ECONOMY IN ROTARY KILNS

[75] Inventors: Bertil Pettersson, Gavle, Sweden; Borje Thorsstrom, Grankulla, Finland

[73] Assignee: Termorak Oy, Helsinki, Finland

[21] Appl. No.: 698,639

[22] Filed: Feb. 6, 1985

[30] Foreign Application Priority Data

Feb. 6, 1984 [SE] Sweden ..... 8400578
Jan. 21, 1985 [FI] Finland ..... 850260

[51] Int. Cl.[4] ..... F27B 15/18; F27B 9/12; F27B 7/14; F27B 7/36

[52] U.S. Cl. ..... 432/17; 432/14; 432/18; 432/105; 432/110; 432/111; 432/118

[58] Field of Search ..... 432/103, 105, 110, 111, 432/118, 119, 14, 17, 18

[56] References Cited

U.S. PATENT DOCUMENTS

| | | | |
|---|---|---|---|
| 1,898,480 | 2/1933 | Corkill | 432/110 |
| 2,743,918 | 5/1956 | Struckmann | 432/110 |
| 2,809,024 | 10/1957 | Simon et al. | 432/118 |
| 3,155,380 | 11/1964 | Lessard | 432/111 |
| 3,780,447 | 12/1973 | Fales | 432/118 |

FOREIGN PATENT DOCUMENTS

| | | | |
|---|---|---|---|
| 346383 | 1/1905 | France | 432/105 |
| 414845 | 9/1910 | France | 432/118 |
| 277916 | 9/1951 | Switzerland | 432/118 |
| 2111178 | 6/1983 | United Kingdom | 432/105 |
| 0953406 | 8/1982 | U.S.S.R. | 432/103 |

*Primary Examiner*—John J. Camby

[57] ABSTRACT

A rotary kiln, in particular, a kiln for reburning of lime mud, wherein the drying and intermediate zones of the kiln chamber are furnished in part with turbulence-forming baffle arrangements to produce a turbulent motion in the hot combustion gases and thereby to force the hotter gases, which flow through the axial central region of the kiln, out towards the kiln wall. The kiln shell is additionally furnished in part with thresholds in order to increase the transit time of the material through the kiln and further with lifters and a cog-wheel lining in order to lift the material and bring it into contact with the gases. The burner tube can be furnished with turbulence-forming baffles and the surrounding kiln shell with lifters and with thresholds at both ends of the burner tube. The baffles are preferably conical in cross-section with the apices coincident with the center of the cross-section of the kiln.

18 Claims, 17 Drawing Figures

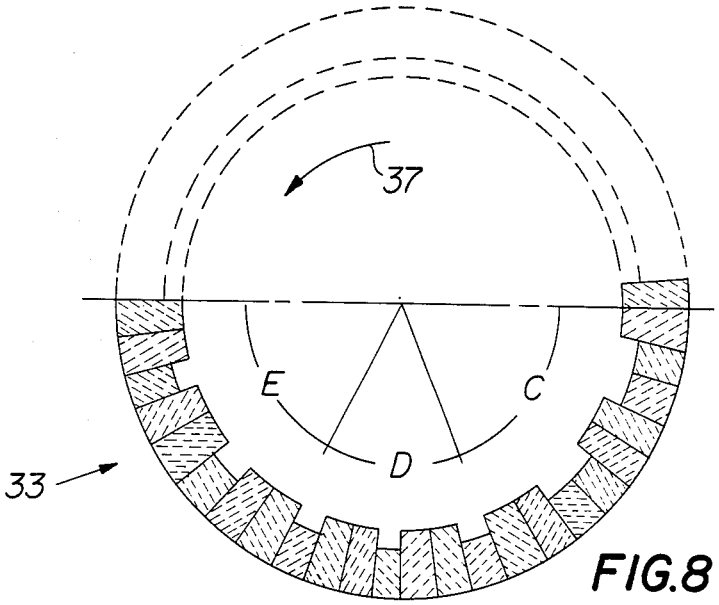
FIG.8
FIG.9
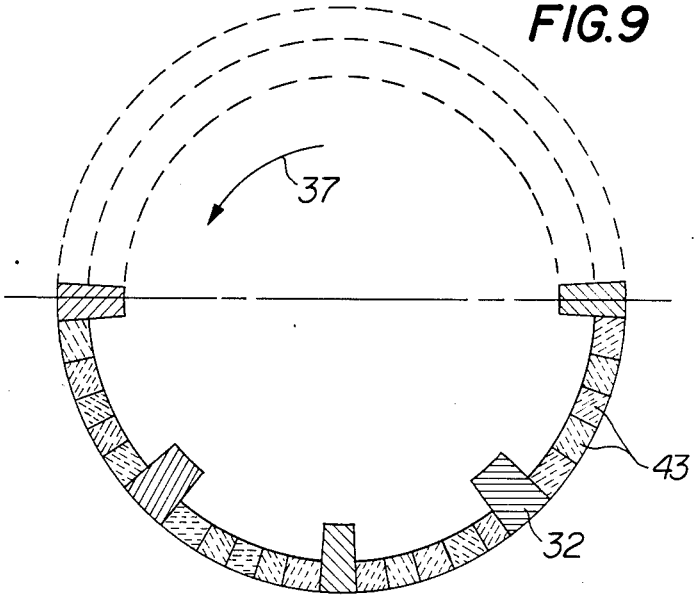

METHOD AND ARRANGEMENT FOR IMPROVING THE HEAT ECONOMY IN ROTARY KILNS

FIELD OF THE INVENTION

This invention relates to an arrangement for improvement of heat economy in rotary kilns, in particular, kilns for the reburning of lime mud.

The invention will be described in connection with the reburning of lime mud, but includes all types of treatment of material in rotary kilns in which the gas flow and material stirring are similar to those in a kiln for reburning lime mud.

BACKGROUND OF THE INVENTION

Lime mud is the calcium carbonate mud which is produced during the causticizing of the green liquor with quicklime in connection with chemical recovery in sulphate pulp mills.

The quicklime required for causticizing is for the main part obtained by reburning the lime mud, usually in a rotary kiln.

The rotary kiln is slightly inclined so that the lime mud which is fed in at the upper end of the kiln moves, as a consequence of the rotation of the kiln, towards the lower end of the kiln and meets the combustion gases from an oil, gas or solid fuel burner in the lower end of the kiln and is therely converted to quicklime. This quicklime is fed out from the lower end of the kiln.

The lime mud is fed into the rotary kiln with a dry solids content of 60–75%. The kiln is usually divided into three zones: a drying zone, an intermediate zone and a combustion zone. The drying zone, which normally comprises about one-third of the length of the kiln is, for most of its length, furnished with slack hanging chains having both their ends fastened to the kiln wall. The purpose of these chains is to stir the mud in order to obtain rapid and effective drying of the mud. The intermediate zone, which comprises about one-half of the length of the kiln, is normally furnished, wholly or in part, with longitudinal fins projecting from the kiln wall for stirring the fine granular material so as to improve the transfer of heat. The combustion zone, where the calcination of the calcium carbonate to calcium oxide takes place at a temperature in excess of 900° C. and usually 1000°–1400° C., is lined with high-grade refractory insulating material. The combustion gases leave the rotary kiln with a temperature which is normally between 170° C. and 240° C.

Measurements during conventional operation of lime mud reburning kilns have shown a very much higher temperature for the outgoing combustion gases than that on the kiln wall. From this the conclusion can be drawn that a large part of the combustion gases pass through the center of the kiln with limited transfer of heat to the lime mud and that the heat economy of the process is poor.

It has earlier been known for measures to be taken to improve the heat economy of rotary kilns in connection with the burning of cement and similar materials. In German Pat. No. 618085 and Russian Pat. No. 830094 there is shown examples of such techniques. According to these patents measures have been concentrated solely on the chain zone, i.e., the zone in which the feed-in occurs and shortly thereafter. According to the German patent this zone is furnished with two or more stationary disks located at distance from each other and having central apertures and with baffles hung in chains and with free room in the radial direction around the baffles. At the same time the chain zone is furnished with slack hanging chains running in an axial direction. Additionally there is a shovel-like pusher plate on the inner surface of the kiln shell adjacent to the end of the feed-in pipe. The combustion gases are forced to move sinuously through the alternately located central apertures in the disks and the peripheral openings around the baffles. At the same time the chains pull through the material on the bottom of the kiln, dragging it up along the shell wall from where it falls down and comes into contact with the hot gases. The material also receives heat from the chains, which during their rotation absorb heat from the combustion gases. The construction is heavy and costly and its object is principally to achieve effective drying of the wet material fed in.

According to the Russian patent, the cold zone of the kiln, the feed section, is furnished with centrally suspended baffles placed near each other. The first of these baffles is conical and the subsequent baffles are conically shaped rings, which all lie relatively close to one another, even so close as to partially overlap one another. The maximum distance between the cones corresponds to 0.2 times the larger diameter of the preceding cone. A set of chains is arranged so that each chain hangs down over one of the cone-shaped surfaces and thereby frees that surface from dust. Another set of chains lies behind the baffles viewed in the direction of motion of the combustion gases. These latter chains have as their purpose to free the combustion gases from dust. A principal object of the invention in the Russian patent is to achieve constancy of flow velocity both along the length of the kiln and across its cross-section in order thereby to attain the best possible removal of dust from the gases and good transfer of heat in the feed section.

SUMMARY OF THE INVENTION

It is the principal object of the present invention to achieve more effective exchange of heat between the combustion gases on the one hand and the lime mud and kiln lining on the other hand.

The invention is based on the observation that the material in the intermediate zone, where the temperature is between 100° C. and 550° C., consists of very fine powder with a unit weight of only approximately 0.8 ton/m$^3$. Such a fine powder tends merely to slide along the lining of the kiln and consequently very poor mixing of the material is obtained. As the material has moreover poor heat transmission, i.e., it behaves as an insulating material, the overall transfer of heat between the combustion gases and the lime mud is very poor. Further, concerning the gas flow in this zone, it has been observed that although the flow is turbulent, layers with different temperatures occur because gases of different temperatures do not mix with each other without external influence and that the gas layer in the center of the kiln has a much higher temperature, approximately 150° C.–300° C. higher, than the temperature of the gas which is in contact with the kiln lining and the lime mud.

In accordance with the arrangement of the invention turbulence formers comprising baffles are placed in the drying and intermediate zones and further stirrers are fitted to stir the lime mud in the kiln, the stirrers comprising steel lifters in the cooler part of the kiln and a ceramic cog-wheel-like lining or alternatively heat resistant steel lifters in the hotter part of the kiln.

By means of the arrangement disclosed herein gas channeling is prevented in the rotary kiln and the hotter combustion gases which normally flow through the center of the kiln are forced out towards the periphery and mix with the cooler combustion gases, at the same time as a totally turbulent flow is obtained behind the baffles, wherein a considerable improvement is obtained in the transfer of heat to the lime material and an advantageous effect on the heat economy. Moreover, the time spent by the combustion gases in the kiln is increased, particularly for the hotter gases, in comparison with the gas flow in a conventional kiln. Since the hotter combustion gases have large radiative emission this increase in the transit time of the gases through the kiln is of considerable significance to the heat transfer. By means of the arrangement of the invention the flow velocity of the gases in the kiln at a certain cross-section can be reduced from a value of approximately 3.8–4.0 m/s to approximately 1.8 m/s.

By means of the arrangement of the invention the hanging chains can be entirely removed or limited to a considerably shorter part of the total length. This is a consequence of the fact on the one hand that the heat transfer lower in the kiln is more effective, so that the heat transfer function of the chains is no longer required, and on the other hand, that the amount of dust carried by the gases decreases radically when the velocity of the combustion gases is reduced, so that the dust collection function of the chains is not required.

The temperature necessary in the combustion or calcination zone depends not only on the time for which the material is present within a region with a temperature permitting the calcination reaction, i.e., over 870° C., but also on the total time of transit of the material through the kiln. Increasing the transit time of the material through the calcination zone by means of a threshold or dam or decreasing the height of an existing one at a point below the calcination zone has been previously known.

In accordance with the present invention it is intended also to regulate the transit time of the material through other sections of the kiln as a whole, without therefore being forced to change the inclination of the kiln, by means of introducing further one or more thresholds or dams higher up in the kiln. These simultaneously ensure a more even flow of material to the calcination zone, which results in a better quality, which has an advantageous effect on the subsequent causticizing process.

Prior known kilns for the reburning of lime mud are not all equipped with arrangements for cooling the material after calcination and for recovery of the heat thereby released. Since by means of the arrangement of the invention both significantly better heat economy and also increased production capacity per volume unit in the kiln are obtained, it is possible either to produce considerably more lime in the kiln equipped according to the invention or, while retaining or somewhat increasing the capacity, to use part of the existing kiln shell to cool the material and pre-heat the combustion air. This has an additional positive effect on the heat economy.

In practice this reallocation of the use of the kiln shell is realized by moving the threshold which is located below the calcination zone upwards along the kiln shell and at the same time correspondingly lengthening the burner tube. The part of the kiln shell thereby made available is furnished with steel lifters or ceramic lifters and turbulence formers to achieve more effective heat transfer. The lifters are installed on the kiln shell and the turbulence forming baffles on the burner tube.

The turbulence forming arrangements can be flat circular baffles but are advantageously conical and of such an area that they cover 15–35% of the cross-sectional area of the kiln. The baffles are preferably fastened at equal distances from each other by chains to the kiln wall so that the centers of the baffles coincide with the center of the cross-section of the kiln. The apices of the baffles are directed towards the lower end of the kiln, i.e., directed against the gas flow. In general 3–6 baffles, placed at constant intervals in the drying and intermediate zone, are sufficient. These baffles force the combustion gases out towards the periphery and ensure, according to observations, complete turbulence for a distance of approximately 15 D behind the baffle in the direction of flow of the combustion gases, where D is the outer diameter of the baffle. The baffles are preferably an equal distance from each other and the first one is placed in the drying zone, just below the chains, if such are used, or otherwise rather near the upper end whereby the distance from the upper end to the first baffle is about one-half the distance between the baffles.

The arrangements for stirring the lime mud and for effectively mixing it with the turbulent combustion gases consist of steel lifters and/or a ceramic cog-wheel-like lining built on the shell wall. Disk or cup shaped lifters are suitable installed in the cooler part of the kiln comprising approximately 60% of the length of the kiln counted from the upper end around the periphery thereof. The cog-wheel-like lining is installed in the hotter part of the kiln, in the intermediate zone, comprising approximately 40% of the length of the kiln and comprises a brick lining, in which each alternate brick in each course has a height difference. Alternatively lifters of heat resistant steel can be used here. This construction aims both to stir the material and also to lift the material higher up as the kiln rotates, from which height the material falls down through the gas stream and is thereby effectively heated.

All the above-mentioned measures according to the invention apply to the drying and intermediate zones of the kiln and the lowest part of the kiln, whereas the feed or chain zone is left unchanged or shortened.

When the invention is applied to the conversion of old rotary kilns by carrying out the re-equipment of the interior of the kiln it is possible to achieve the aforementioned very considerable energy saving and increase in productive capacity.

When the invention is applied to the building of new rotary kilns it is possible to make the kiln shell approximately 20% shorter than a convention kiln shell, which decreases the investment costs and at the same time gives improved heat economy.

BRIEF DESCRIPTION OF THE DRAWINGS

In the following the invention is described in greater detail with reference to the accompanying drawings which illustrate advantageous embodiments of the kiln furnished with equipment according to the invention.

FIG. 8 shows a diagrammatic and schematic cross-sectional view of the intermediate zone showing a ceramic cog-wheel-like lining;

FIG. 9 shows a diagrammatical and schematic cross-sectional view of part of the intermediate and drying zone showing metallic lifters embedded in a ceramic lining;

DESCRIPTION OF THE PREFERRED EMBODIMENTS

Figure 1:
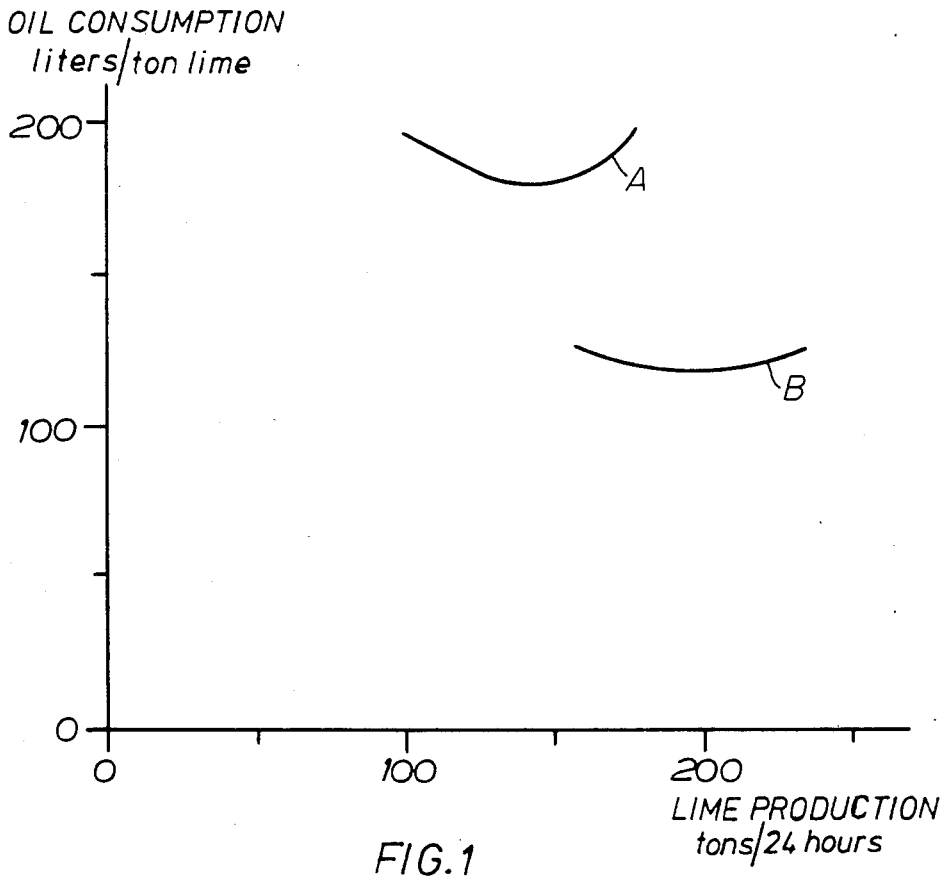
FIG. 1 shows graphically a comparison between the oil consumption in relation to the produced amount of lime in a known rotary kiln before and after the conversion of the kiln according to the present invention.

In the graphical representation of FIG. 1 of the oil consumption in relation to produced amount of lime, the oil consumption is expressed in liters per ton of lime and the produced amount of lime in tons per day. The results have been obtained in a known rotary kiln before the conversion of the kiln and after its conversion according to the invention. This known kiln is the one shown in FIG. 2. The length of this kiln is 87 m and its inner diameter is 3.15 m. There are no chains according to the prior art in the kiln but such chains may be used. A comparison between the optimal points on the two curves A and B shows a reduction of approximately 50 l in the oil consumption per ton, equivalent to approximately 30%, at the same time as the daily production increases from approximately 150 tons to approximately 200 tons, equivalent to 35% in curve B. A comparison between the two curves also shows that the curve B has a considerably more advantageous shape than curve A. The oil consumption is not so sensitive to variations in loading, but remains near the minimum value over a wide range of capacity. Curve B also shows a difference over curve A between the maximum production figures or approximately 70 tons/day, equivalent to approximately 40% increase.

Figure 2:
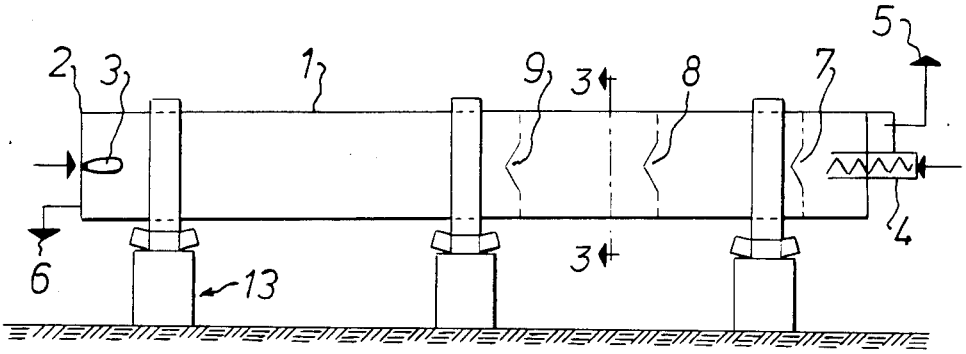
FIG. 2 shows a diagrammatic and schematic cross-sectional representation of a rotary kiln having turbulence formers in the form of conical baffles.
Figure 3:
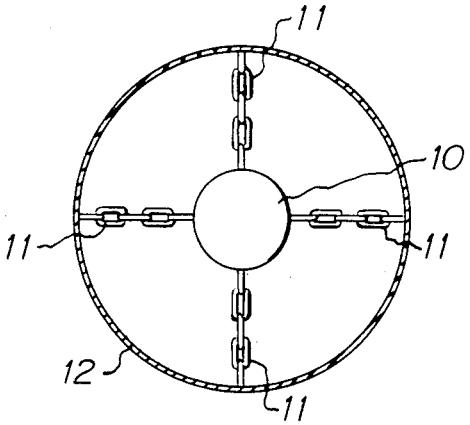
FIG. 3 shows a cross-section of the kiln of FIG. 2 drawn on a larger scale showing the conical baffle.

In FIG. 2 the rotary kiln 1 is supported at an incline and rotated by the structure 13. The kiln has a lower end 2. An oil burner 3 is at the discharge end 2 and a screw 4 for feeding in the lime mud is at the cool end of the kiln. An outlet 5 provides for the combustion gases. An outlet 6 provides for the lime at the discharge end 2; baffles 7, 8 and 9 of the present invention are disposed in the kiln 1. In FIG. 3, a baffle 10 is suspended by chains 11 in the kiln shell 12. The three baffles 7, 8 and 9 are placed in the kiln at equal distances from one another: 15 m, 25 m and 35 m from the upper end of the kiln where the feed screw 4 for the lime mud is located. The baffles 7, 8 and 9 each cover 15–35% of the cross-sectional area of the kiln chamber.

Figure 4:
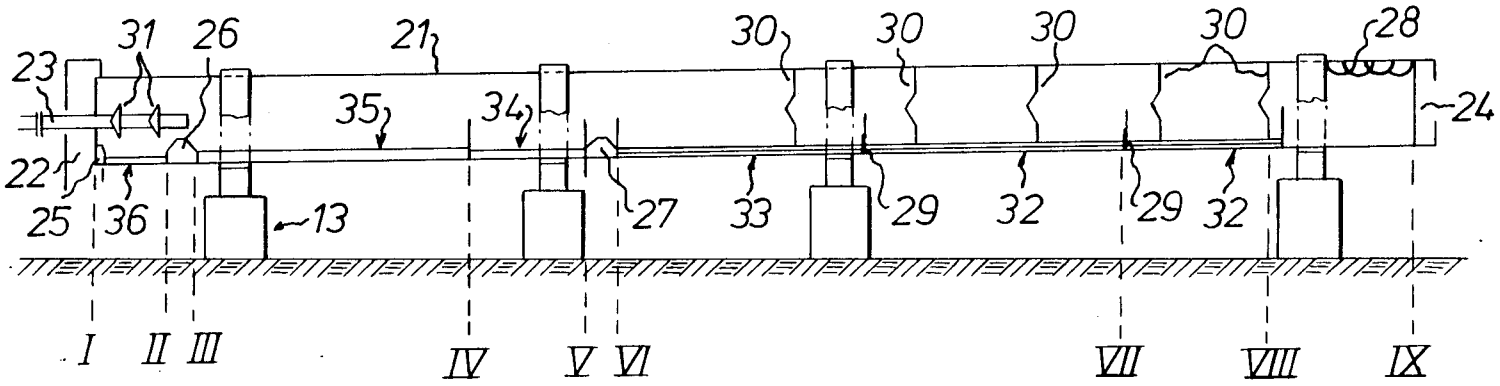
FIG. 4 shows a diagrammatic and schematic cross-sectional representation of a kiln having turbulence formers and stirrers and thresholds also around the oil burner.

The kiln of FIG. 2 is provided with three baffles 7–9 and the kiln of FIG. 4 is provided with five baffles 30. The amount of baffles is preferably 3–5, but a sixth baffle could be used at equal distances from the fifth baffle 30 towards the lower end of the kiln.

The baffles mounted in a kiln are preferably of the same form. The baffles may have the form of angular plates or they may be formed as cones. The outer diameter of the baffles should be 15–35% of the cross-section of the kiln. The cone angle of the baffles is greater than 100° and at least 130°, preferably 150°. The baffles are made of metal with a heat resistance that is adapted to the position in the kiln and the temperature in that region. The baffles are suspended by chains of the same material in the mantle of the kiln. The chains 10 are light chains and their only task is to suspend the baffles.

The length of the kiln shown in FIG. 4 is 84 m and its inner diameter is 3.35 m. The kiln has no planetary cooler but is furnished with baffles 31 on the burner tube and with stirring means 36 on the kiln shell around the burner tube, which act as cooling means that recovers heat from the burnt lime to the gases. In FIG. 4 a rotary kiln 2 has a discharge end 22 with a burner tube 23 and at the other end a feed 24 for the lime mud. The feed arrangement, known per se, and the outlet for the combustion gases have been omitted from the figure. The kiln shell is divided into zones denoted I–IX on the basis of the different kiln lining and functions. Lowest down at the outlet end at zone I there is a threshold 25 around the end of the burner tube and between zones II and III there is a higher threshold 26. The region between the thresholds 25 and 26 has ceramic lifters fastened to the kiln wall or alternatively lifter of heat resistant steel. The region of the kiln between zones III and IV constitutes the combustion zone and has a high-grade refractive and insulating lining. The zone from the end of the combustion zone up to zone VII constitutes the intermediate zone and the uppermost zone between zones VII and IX constitutes the drying zone. The lining of the intermediate zone comprises partly of a ceramic cog-wheel-like lining and partly of steel lifters, whereas the lower end of the drying zone, between zones VII and VIII, is furnished with steel lifters and the upper end, between zones VIII and IX, is furnished with slack hanging chains 28. In the intermediate zone of the kiln there are two further thresholds 27 and 29. In a kiln with a smaller inclination the upper threshold can be omitted. In that case a suitable transit time for the material through the kiln is obtained with only one threshold in the intermediate zone. Between the intermediate zone and the drying zone, at zone VII, a threshold plate 29 is fixed. The turbulent forming baffles 30 in the intermediate and drying zones are five in number. Two baffles 31 are fixed on the burner tube, and these in combination with the lifters 36 in the region contribute to the recovery of heat from the burnt lime. Metallic lifters 32 are located in the upper part of the intermediate zone and a ceramic cog-wheel-like lining 33 is in the adjacent lower part of the same zone, between the thresholds 27 and 29. An insulate lining 34 is in the lowest part of the intermediate zone and high-grade refractive and insulating lining 35 is located in the combustion zone. Ceramic lifters 36 are in the region between the thresholds 25 and 26. The lifters 36 together with the baffles 31 mounted on the burner tube 23 create an effective contact between the gas blown in through end 22 and the burnt lime fed out at end 22, thus recovering heat from the burnt lime.

FIGS. 5 to 12 show the lining of the mantle of the kiln in the different regions and zones and, in particular, the stirrers and thresholds. The kiln is rotated in a direction 37.

Figure 5:
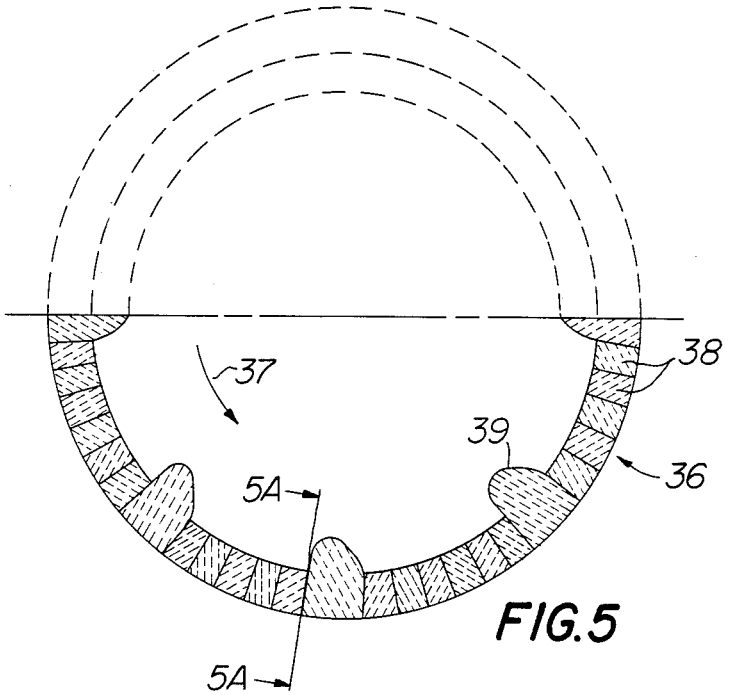
FIGS. 5 and 5A show a diagrammatic and schematic cross-section representation of a ceramic lining with a ceramic lifter.
Figure 5A:
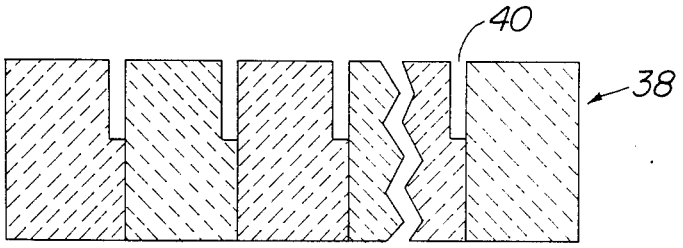

The region 36 between the thresholds 25 and 26, i.e., the region around the burner tube 23, is preferably furnished with a ceramic lining 38 with ceramic lifters 39 embedded therein, as shown in FIG. 5. The longitudinal lifters 38 are cut at short intervals 40 to provide for heat expansion space, as shown in FIG. 5A.

Figure 6:
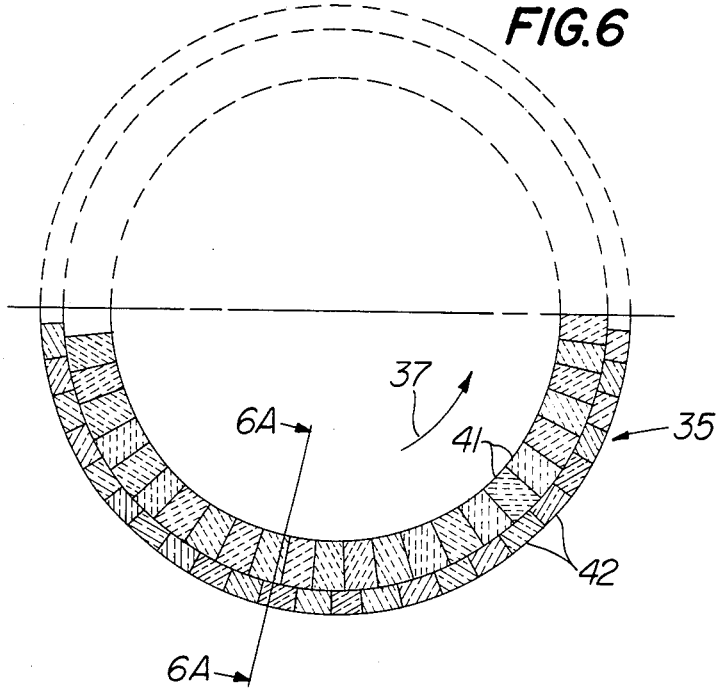
FIGS. 6 and 6A show a diagrammatic and schematic cross-sectional representation of the combustion zone having a refractory and insulating lining.
Figure 6A:
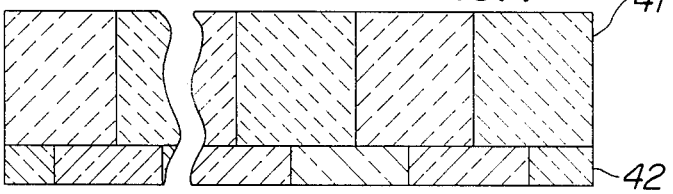

The lining 35 of the combustion zone between zone III and IV comprises a high-grade refractive lining 41 and insulating lining 42 as the outermost layer, as shown in FIGS. 6 and 6A.

Figure 7:
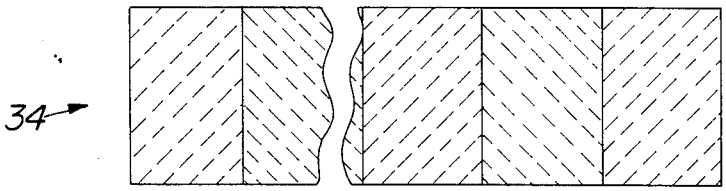
FIG. 7 shows a diagrammatical and schematic cross-sectional view of part of the intermediate zone showing a ceramic lining.
Figure 10:
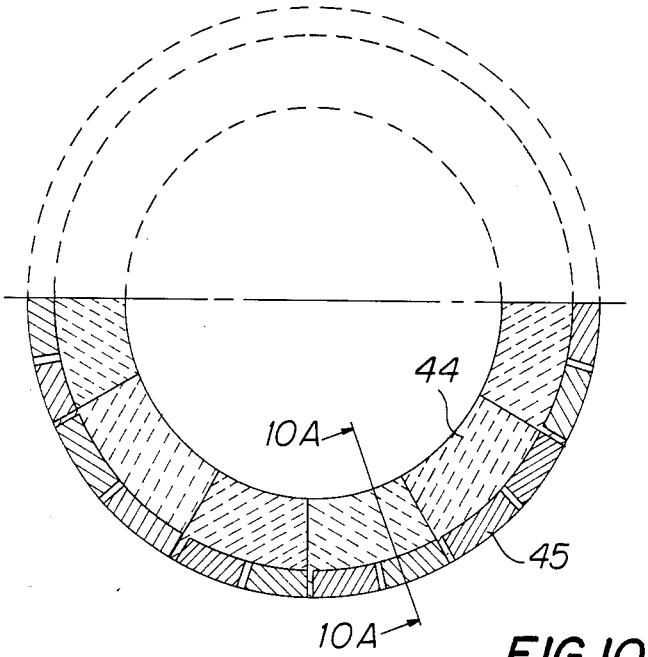
FIGS. 10, 10A, 11, 11A, 12 and 12A show diagrammatical and schematic cross-sectional view of the threshold or dams in the rotary kiln.
Figure 10A:
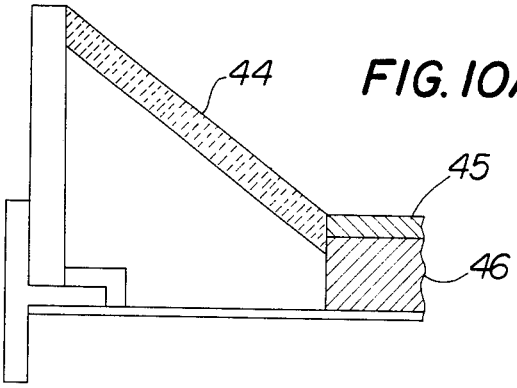
Figure 11A:
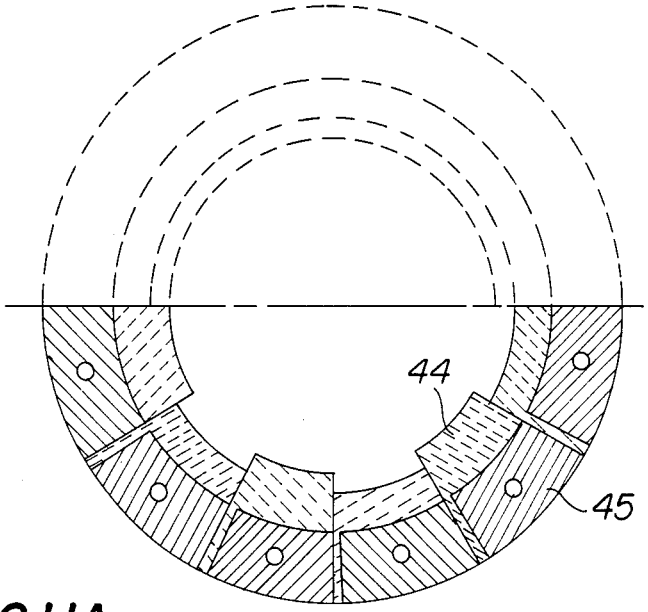
Figure 11:
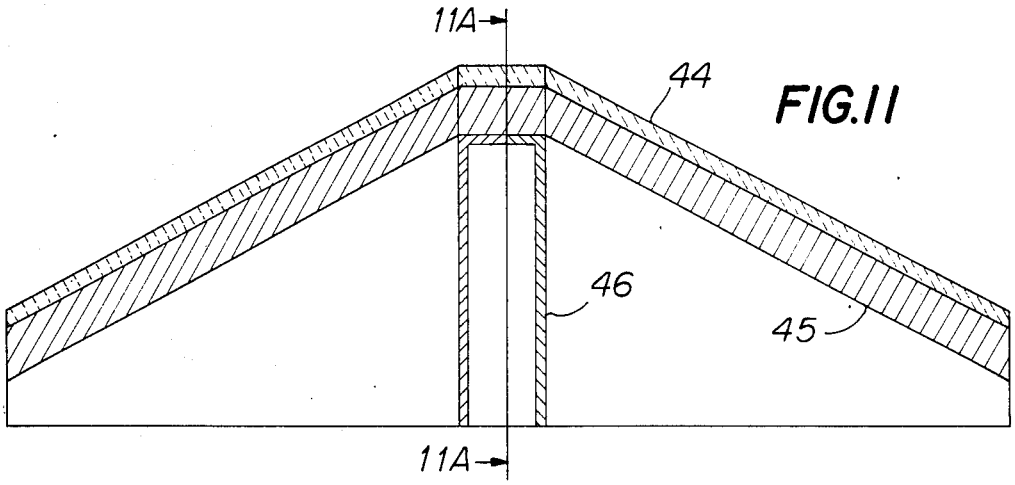

The lowest part of the intermediate zone, between zones IV and V, is provided with a ceramic lining 34, as shown in FIG. 7. The part of the intermediate zone extending between thresholds 27 and 29 is lined with a ceramic cog-wheel-like lining 33, as shown in FIG. 8. As shown in FIG. 8 there are three different types of cog-wheel configurations, indicated as C, D and E. Type C comprises two lower and two higher bricks alternating with each other; type D comprises two higher and one lower bricks alternating with each other; and type E comprises a two-one-two-one configuration of higher and lower bricks alternating with each other.

The upper part of the intermediate zone, between the thresholds 29 and the lower part of the drying zone, below the chains 28, (between zones VII and VIII) the mantle of the kiln is lined with metallic lifters 32 embedded into a ceramic lining 43 from which the lifters 32 are protruding, as shown in FIG. 9. In this preferred embodiment, there are eight lifters mounted in the lining. However, there may be four to twelve lifters 32.

The thresholds 25 and 26 comprise a thick layer of ceramic material 44 which is molded on a steel constuction 45, as shown in FIGS. 10 and 10A and FIGS. 11 and 11A. The thresholds are preferably prefabricated and fastened to girders 46 mounted on the mantle. The ceramic surface of the threshold 26 located at the end of the burner tube 23 is arranged as a cog-wheel lining, such as that shown in FIG. 11A.

Figure 12:
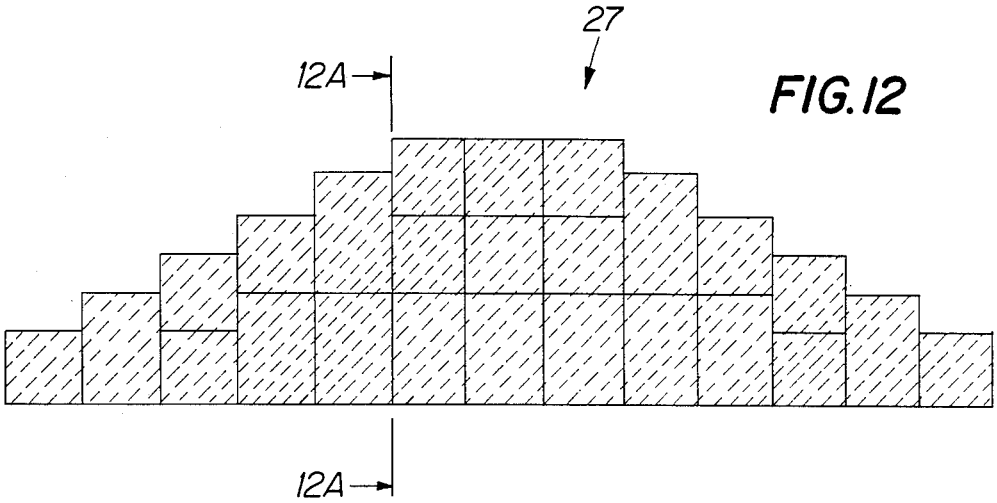
Figure 12A:
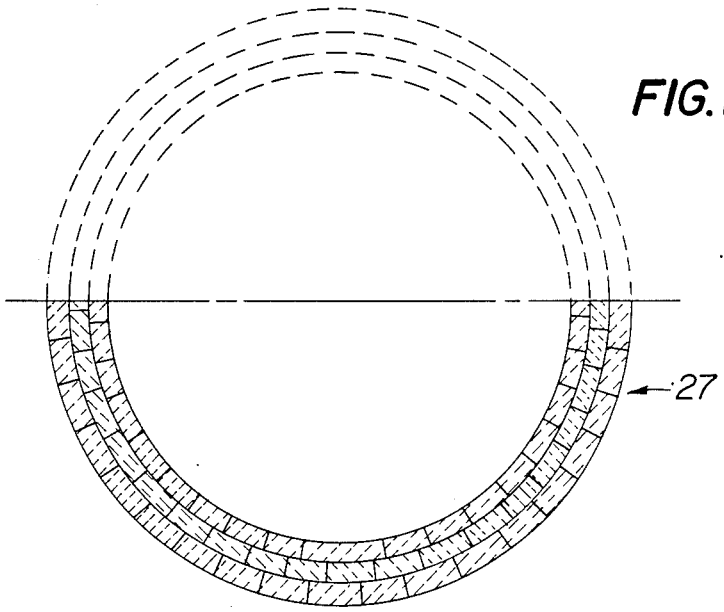

The threshold 27 in the lower part of the intermediate zone is made of three ceramic layers, as shown in FIGS. 12 and 12A. The thresholds 29 in the upper part of the intermediate zone comprise a flat steel construction extending radially inward of the kiln.

The lifters mounted in the lining of the kiln lift the material which is running through the kiln up towards the upper region of the rotating kiln, from where it falls down to the lower region of the kiln. By this movement in the peripheral direction of the kiln and from the upper region to the lower region thereof the material comes into contact with the burning gases and is thereby effectively heated. The function of all the lifters mounted in the kiln is the same, independently of their structure.

The function of the thresholds is to decrease the flowing velocity of the material that runs through the kiln. In rotating kilns having a large inclination angle their presence is necessary in order to slow down the flowing rate of the material and thereby offer more time for contact with the burning gases.

By means of the modification according to the invention, the temperature of the outgoing combustion gases was reduced by some 70° F. (40° C.) during normal quicklime production, from 340°-355° F. (170° C.-180° C.) before the modification to 265°-285° F. (130°-140° C.) after the modification. The reduction in the temperature of the combustion gases is equivalent to a saving of oil of approximately 2.05 US gal/sh tonne (7 l/t) of product (90% CaO).

As is apparent from the above description of the curves of FIG. 1 and of the kiln of FIG. 2, wherein the tests forming the basis of the curves has been performed, an appreciable improvement in heat economy and increase in production capacity are obtained even without the turbulence formers and stirrers around the burner tube, but such an addition further improves the heat economy.

The thickness of the kiln lining varies from 150 to 250 mm, being the greatest in the combustion zone. The maximum height of the threshold 27 in the intermediate zone is approximately 450 mm, while the threshold 26 at the end of the burner tube is approximately 650 mm above the thickness of the lining. The height of the threshold 25, at the outlet end, is approximately 350 mm above the lining and the height of the metallic threshold plates is approximately 300 mm above the lining. The height of the thresholds, however, can vary.

Various modifications in structure and/or function may be made by one skilled in the art to the disclosed embodiments without departing from the scope of the invention as defined by the claims.

What is claimed is:

1. An arrangement for improvement of heat economy in the operation of a rotary kiln having a kiln chamber with discharge and feed ends, combustion, intermediate and drying zones arranged sequentially according to decreasing temeperature within the chamber, the combustion zone being adjacent the discharge end, comprising:

baffle means arranged centrally in the drying and intermediate zones for bringing the combustion gases into turbulence, each of said baffle means occupying 15-35% of the cross-sectional area of the kiln chamber;

means for achieving effective stirring of material in at least the drying and intermediate zones, in a region comprising approximately 30-60% of the total length of the kiln; and one or more threshold means are disposed in the kiln chamber for controlling the material transit time in the kiln.

2. An arrangement according to claim 1 wherein the baffles means have the form of circular plates.

3. An arrangement according to claims 1 or 2 wherein the baffle means have the form of cones, the apices of which are directed against the direction of flow of the combustion gases and are coincident with the center of the cross-section of the kiln.

4. An arrangement according to claim 1 or 2 wherein there are three to six baffle means which are preferably located at equal intervals from each other.

5. An arrangement according to claim 3 wherein there are three to six baffle means which are located preferably at equal intervals from each other.

6. An arrangement according to claims 1 or 2 wherein the baffles means are suspended by chains from the kiln wall.

7. An arrangement according to claim 3 wherein the baffle means are suspended by chains from the kiln wall.

8. An arrangement according to claim 4 wherein the baffle means are suspended by chains from the kiln wall.

9. An arrangement according to claim 1 wherein the stirring means comprises between four and twelve lifters distributed along the periphery of the kiln in a region comprising up to 60% of the total length of the kiln beginning with the upper end thereof.

10. An arrangement according to claim 1 wherein the stirring means comprises ceramic lifters having bricks arranged in a ring which are different in height, the ceramic lifters being located in the intermediate zone and comprising approximately 40% of the length of the kiln.

11. An arrangement according to claim 1 wherein the threshold means comprises ceramic material or metal and is of increasing height in the direction towards the discharge end of the kiln and is arranged around the inner surface of the kiln chamber.

12. An arrangement according to claim 1 wherein the threshold means are arranged in the combustion zone and in the intermediate zone of the kiln, preferably one at the end of the combustion zone, and one between the combustion zone and the intermediate zone and one in the intermediate zone and one between the intermediate zone and the drying zone.

13. An arrangement according to claim 1 wherein approximately 5–10% of the length of the kiln at the combustion zone includes a burner tube and which includes cooling means for recovery of heat from the material in the kiln.

14. An arrangement according to claim 13 wherein one or more baffle means are arranged on the burner tube located at the discharge end.

15. An arrangement according to claims 13 or 14 wherein a threshold means is arranged at the end of the burner tube and another threshold means is arranged at the discharge end of the kiln and wherein the kiln chamber between the threshold means is furnished with lifters.

16. An arrangement according to claim 1 wherein the feed end is adjacent an outlet for the combustion gases.

17. A method for improving the heat economy in the operation of a rotary kiln having a kiln chamber with discharge and feed ends, combustion, intermediate and drying zones arranged sequentially according to decreasing temperature within the chamber, the combustion zone being adjacent the discharge end, comprising the steps of:

providing centrally in the drying and intermediate zones a baffle occupying 15–35% of the cross-sectional area of the kiln chamber;

providing effective stirring of material in at least the drying and intermediate zones and in a region comprising approximately 30–60% of the total length of the kiln;

providing one or more thresholds in the kiln chamber for controlling the material transit time in the kiln;

providing the material into the feed end and causing the material to move toward the discharge end while exposing the material to combustion gases which are brought into turbulence by the baffle.

18. A method according to claim 17 wherein the material flow transverses the kiln chamber in a direction opposite to the direction of flow of the combustion gases.

* * * * *